US005833484A

United States Patent [19]

Post et al.

[11] Patent Number: 5,833,484

[45] Date of Patent: Nov. 10, 1998

[54] CONNECTOR WITH PIVOTABLE COUPLING LEVER

[75] Inventors: Lothar Andreas Post, Offenbach; Jörg Kunze, Rüsselsheim, both of Germany

[73] Assignee: The Whitaker Corporation, Wilmington, Del.

[21] Appl. No.: 626,882

[22] Filed: Apr. 3, 1996

[30] Foreign Application Priority Data

Apr. 21, 1995 [GB] United Kingdom ..... 9508189

[51] Int. Cl.[6] ..... H01R 3/00

[52] U.S. Cl. ..... 439/352; 439/157; 439/347

[58] Field of Search ..... 439/152–160, 439/345, 346, 347, 351, 352

[56] References Cited

U.S. PATENT DOCUMENTS 5,211,572 5/1993 Comstock et al. ..... 439/352
5,322,448 6/1994 Hahn ..... 439/157
5,480,324 1/1996 Maegawa et al. ..... 439/352

FOREIGN PATENT DOCUMENTS 0090502 10/1983 European Pat. Off. ..... 439/352
87 14 016.0 10/1987 European Pat. Off. .
0 273 999 7/1988 Germany .

*Primary Examiner*—J. J. Swann

[57] ABSTRACT

A connector assembly comprises a gear member having a pinion engageable with the rack of a complementary connector. The gear member comprises a lever arm for actuating the pinion. The gear member is latched in the fully coupled position by a resilient latching member of the connector housing. A secondary locking slide member can be shifted from a pre-locked position to a locked position such that an end portion is positioned below the resilient latching arm to prevent biasing thereof. Safe and reliable locking of the complementary connectors is thus achieved.

5 Claims, 6 Drawing Sheets

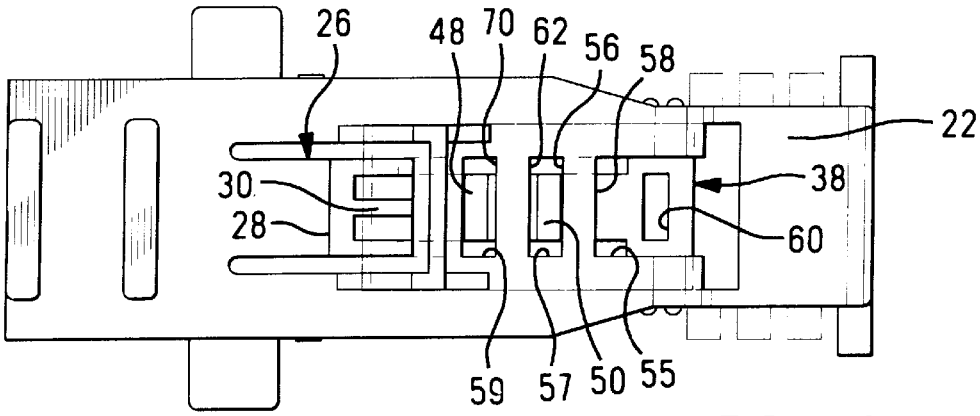
FIG. 3
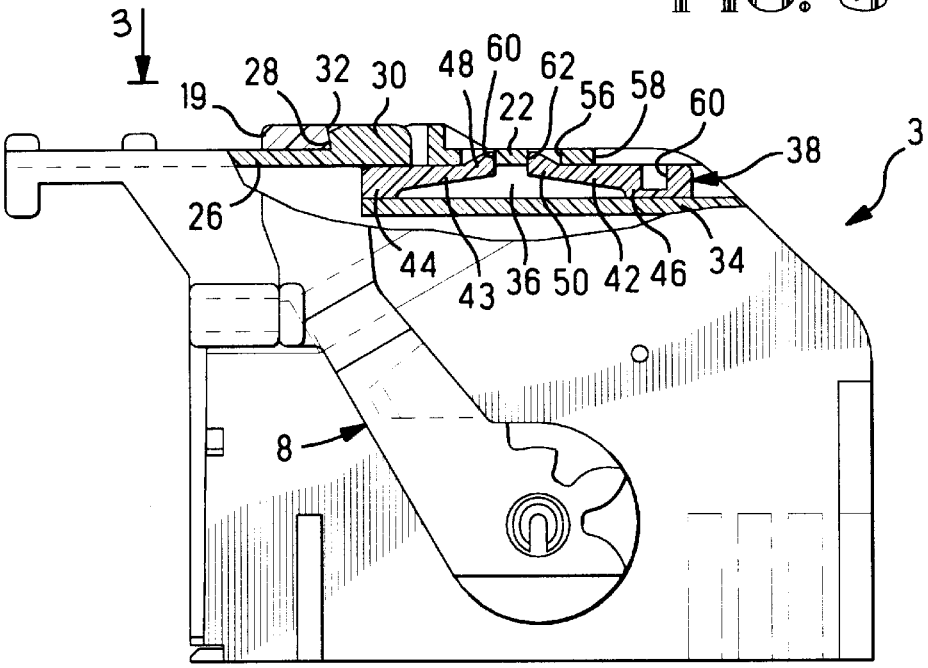
4 FIG. 2
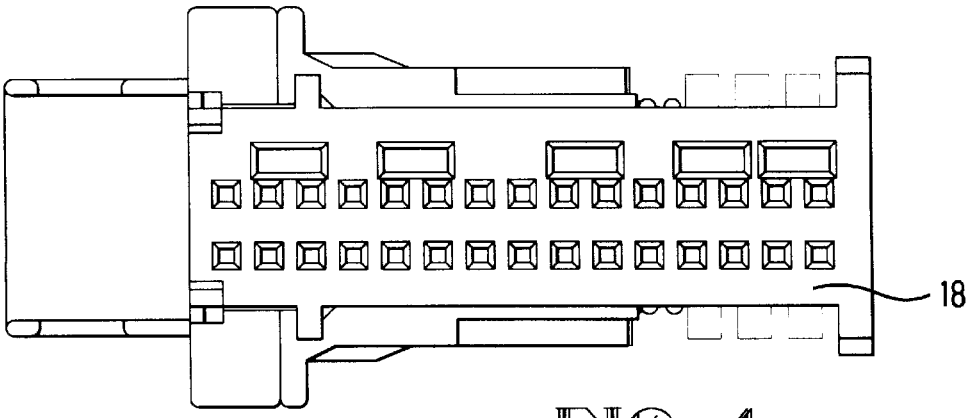
FIG. 4

CONNECTOR WITH PIVOTABLE COUPLING LEVER

BACKGROUND OF THE INVENTION

1. Field of the Invention

This invention relates to a rack and pinion type of locking means for the coupling of complementary connectors.

2. Description of the Prior Art

A rack and pinion mechanism for coupling mating connectors together is known from German Utility Model G 8714016 and shown in FIG. 1, whereby a receptacle connector assembly 4' comprises a gear 10' pivotable about an axis and attached to a lever arm 14'; and a pin header connector assembly 3' comprises a rack 11' along a wall of a cavity 13' receiving the receptacle connector 4'. Mating of the connectors 2' and 3' is effectuated by simply inserting the receptacle connector into the cavity of the pin-header connector whereby engagement of the rack 11' and pinion 10' causes the gear arm 14' to rotate and allow full insertion of the receptacle connector into the male housing cavity. Uncoupling of the mating connectors 2', 3' is effectuated by simply rotating the lever 14' in the opposite sense.

In order to ensure locking of the mated connectors, the lever can be latched in it's final coupled position by some resilient latching means 15'. In the open position the lever arm 20 should be held in a fixed position such that coupling of the connectors is rapidly done by merely inserting the connectors and snapping them together. The gear lever arm of the Utility Model engages the receptacle housing with a dimple thereon for resiliently holding the lever in the fully open position, the lever being rotatable into the closed position by simply exerting sufficient torque to the gear (which occurs when firmly pressing the mating connectors together).

One of the problems associated with the prior art resilient latching means 15' in the coupled position, is that the lever arm 14' can be released from the closed position by either exerting sufficient upward force on the lever arm, or by depressing the resilient latching means 15. Such connector systems are sometimes used for automotive airbag applications, where it is important to ensure that the connectors are correctly coupled together, and cannot be accidentally uncoupled. Safety mechanisms such as airbags require a very secure and reliable retention of connection systems.

SUMMARY OF THE INVENTION

It is therefore an object of this invention to provide a connector with a reliable and secure coupling mechanism, in particular when the connector is coupled to a complementary connector.

It is an object of this invention to provide a connector with a pinion-type of coupling and locking means that is securable in the fully coupled position in a reliable manner such that it cannot be accidentally released.

It is a further object of this invention to provide a connector with a secure retention and coupling mechanism that is cost-effective and reliable.

Objects of this invention have been achieved by providing an electrical connector assembly matable to a complementary connector assembly, the connector assembly comprising a rotatable gear member having a lever arm and a pinion attached to one end of the lever arm, the pinion engageable with a complementary rack of the complementary connector assembly, wherein the connector comprises a resilient latching mechanism for primary locking of the lever in the coupled position, the connector further comprising a secondary locking member movable from a first position whereby the primary latching means can be resiliently biased, to a second locked position whereby the resilient latch member is locked such that the lever arm cannot be released. The secondary locking member could be a plate-like structure having resilient latches that engage with shoulders of the connector housing such that it can be latched in the first and second positions respectively. The secondary locking member could be received in a slot in the connector housing adjacent a top surface of the housing remote from a mating face thereof. The lever arm latching member could be in the shape of a cantilever beam, having a retention shoulder proximate its free end, engageable with an end of the lever arm remote from the pinion, whereby the secondary locking member is movable against a lower surface of the resilient latch arm proximate its free end. Advantageous embodiments are further described in the claims.

BRIEF DESCRIPTION OF THE DRAWINGS

FIG. 2 is a side, partial cross-sectional view of a connector assembly according to this invention;

FIG. 3 is a view in the direction of arrow 3 of FIG. 2;

FIG. 4 is a view in the direction of arrow 4 of FIG. 2;

DETAILED DESCRIPTION OF THE PREFERRED EMBODIMENT

Figure 1:
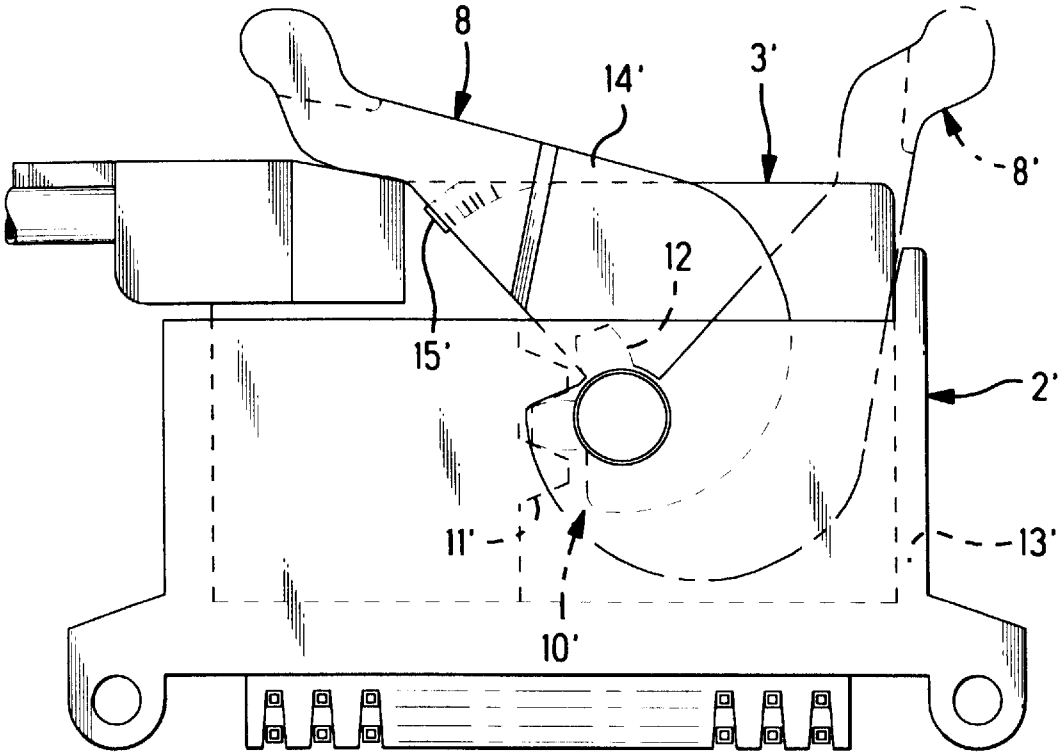
FIG. 1 ( Prior Art )
FIG. 1 is a side view of conventional connector and complementary connector assemblies having rack and pinion coupling means.
Figure 5:
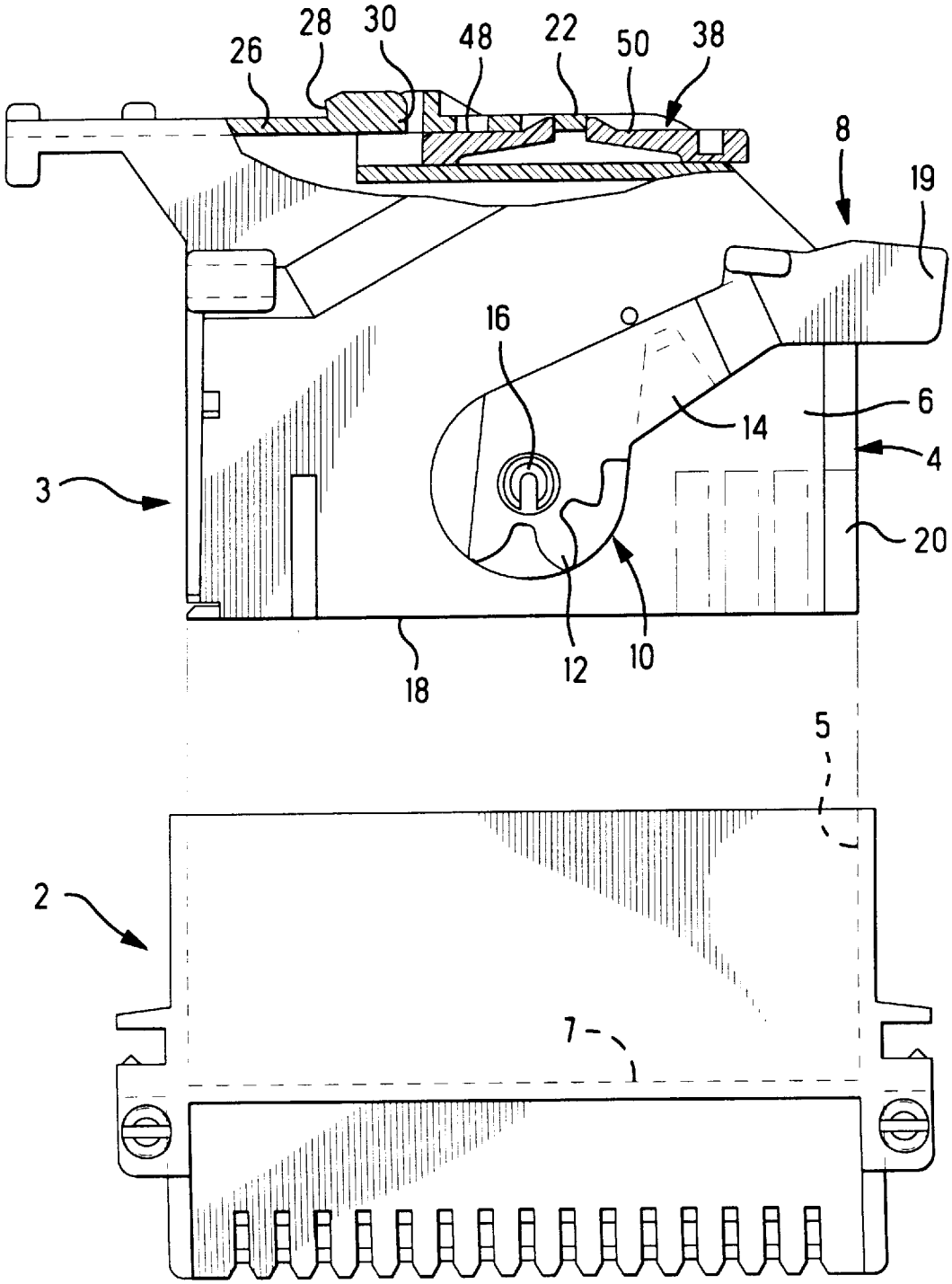
FIG. 5 is a view similar to that of FIG. 2 but with the connector assembly in an arrangement prior to assembly with a complementary connector assembly.

Referring to FIG. 5, a receptacle connector assembly 3 comprises a housing 4 having a main housing 6 for receiving electrical terminals therein, and a gear member 8 comprising a pinion 10 with gear teeth 12, and a lever arm 14. The gear member 8 is pivotly attached to an axis 16 of the housing 4. The terminals mountable in the main housing 6 project towards a mating face 18 thereof, the connector assembly 3 being matable to a complementary connector assembly 2 similar to the connector assembly 2' of the Prior Art. The mating connector assembly would thus comprise a rack similar to the rack 6' for engagement with the gear teeth 12 of the pinion 10 during mating and unmating of the connector assemblies. Similar to the Prior Art shown in FIG. 1, the connector housing 4' would be inserted into a cavity of the complementary connector assembly whereby the pinion 10 and rack would engage causing the gear member 8 to pivot until the fully mated position as shown in FIGS. 6, 7, 8 and 2.

Figure 6:
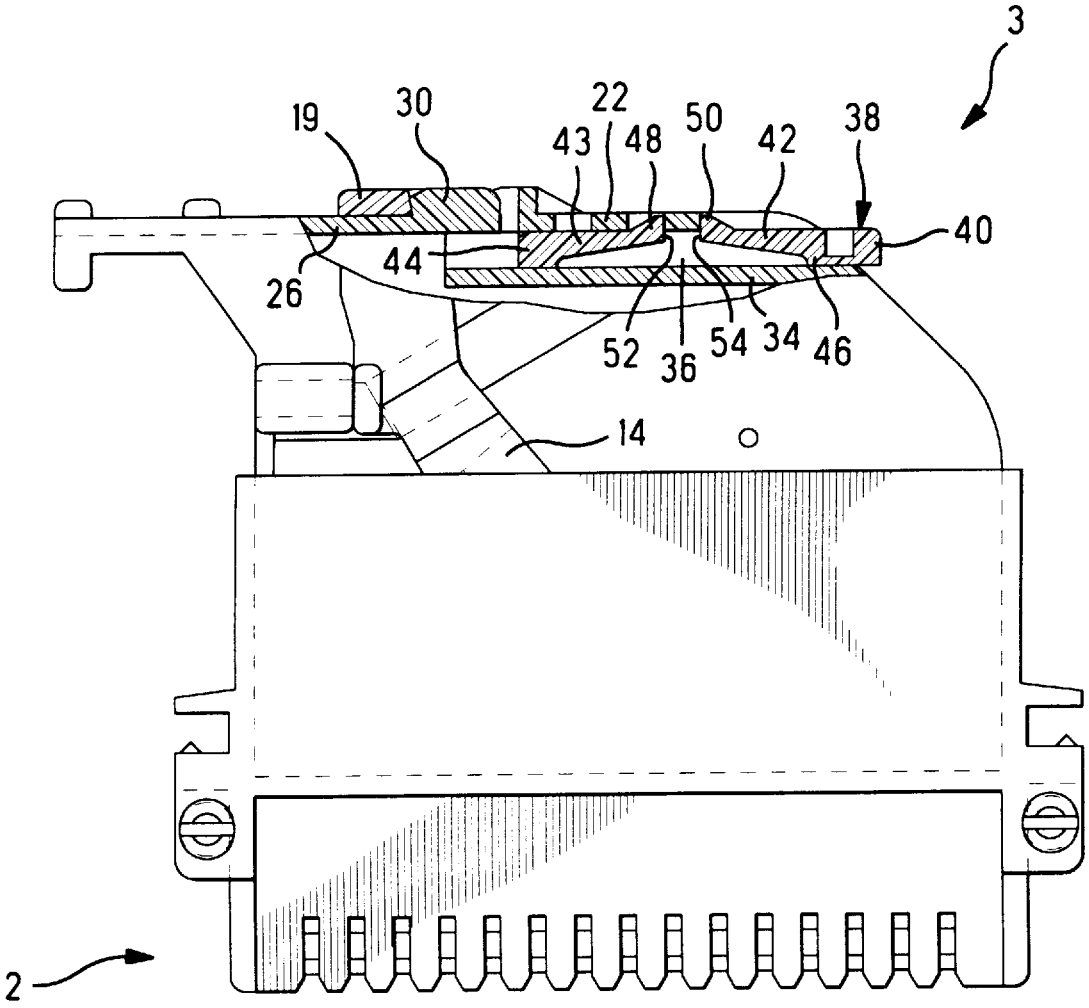
FIG. 6 is a view of the connector assemblies of FIG. 5 coupled together.
Figure 7:
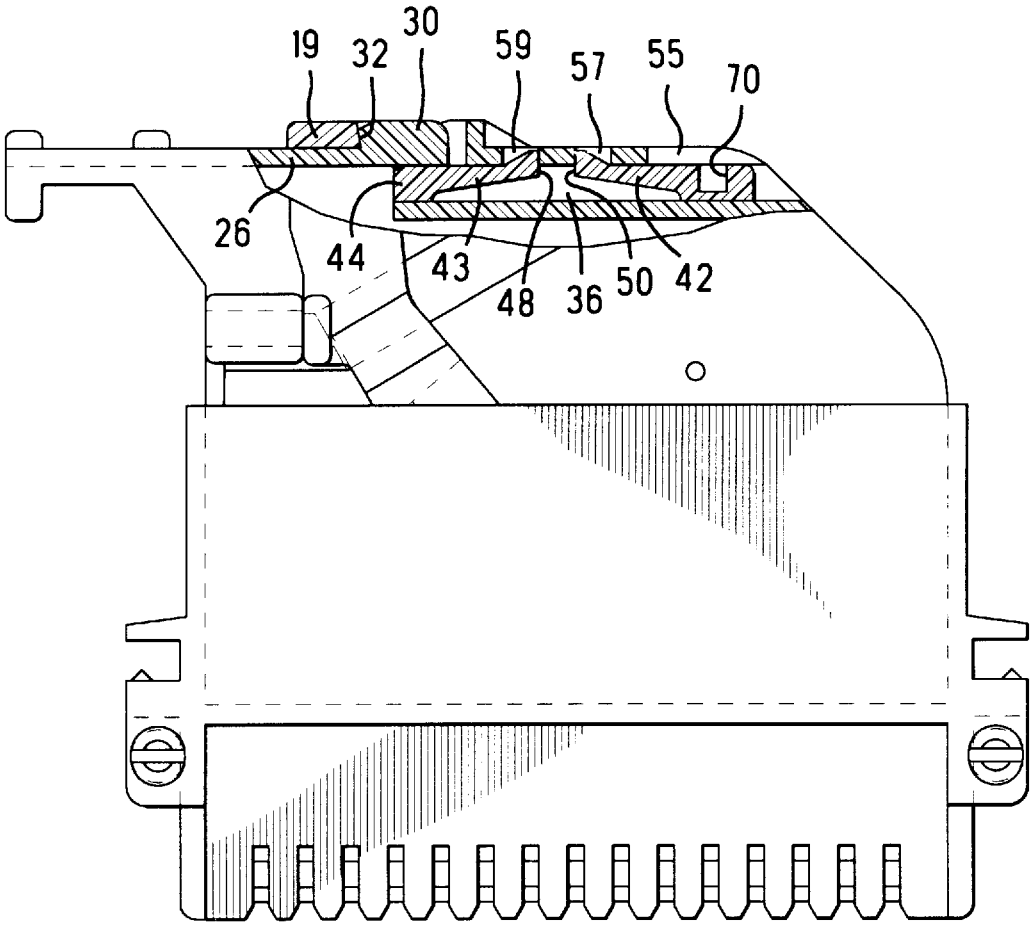
FIG. 7 is a view similar to that of FIG. 6 but with the coupling mechanism in the fully locked position.
Figure 8:
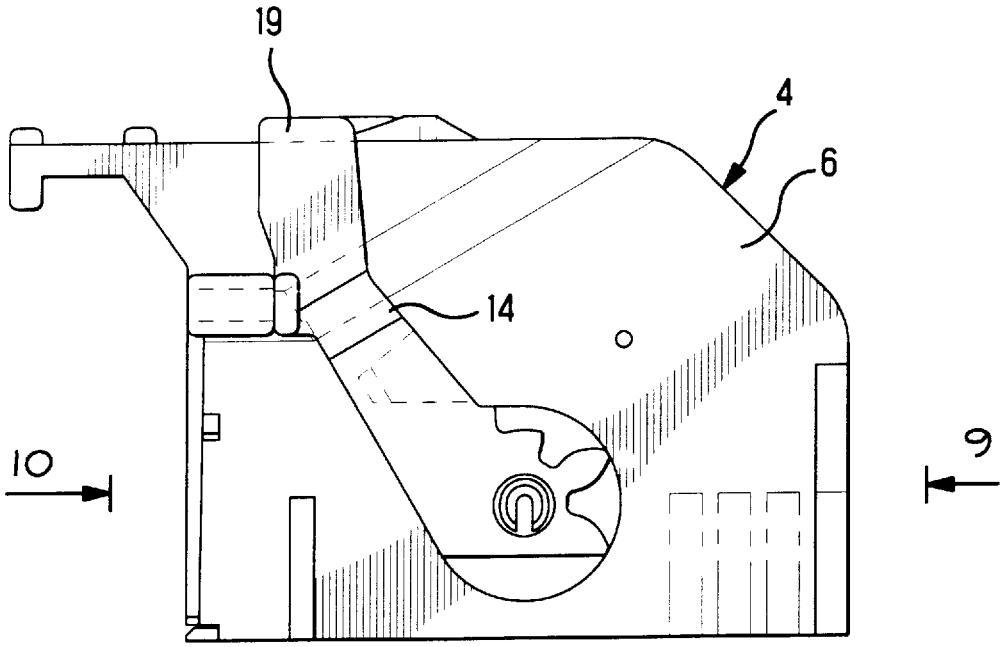
FIG. 8 is a view similar to that of FIG. 2 but without a partial cross-section.
Figure 9:
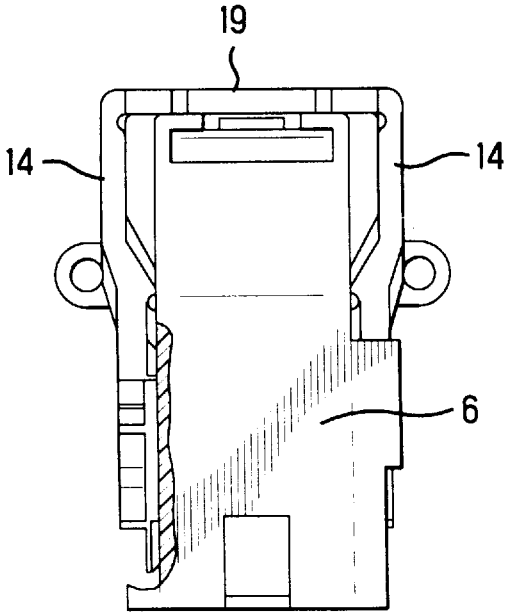
FIG. 9 is a view in the direction of arrow 9 of FIG. 8.
Figure 10:
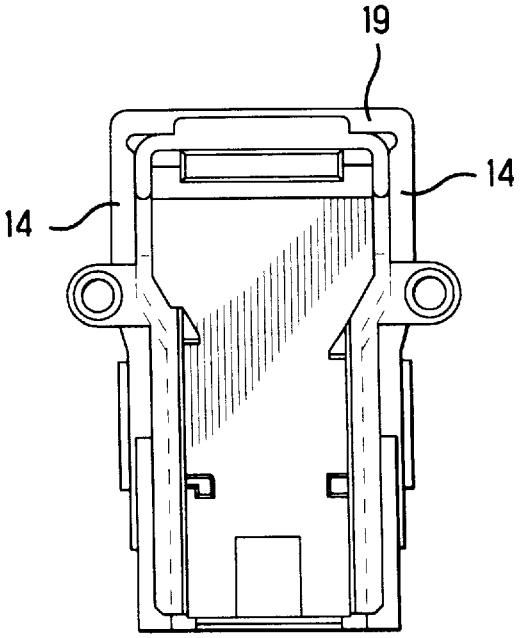
FIG. 10 is a view in the direction of arrow 10 of FIG. 8.

In FIG. 5, the connector assembly 3 is shown in the pre-coupled position whereby the lever arm 14 is in the fully open position such that an end 18 thereof remote from the pinion 10, is adjacent an end face 20 of the housing 6 which spans between the mating face 18 and a top wall 22 remote and opposed thereto. When being coupled to the complementary connector assembly 2, the lever 14 is pivoted by 90° such that the end 19 abuts the top wall 22 in the fully coupled position as shown in FIGS. 2, 6 and 7. As shown in FIGS. 9 and 10, the gear member 8 comprises a pair of the lever arms 14 on either side of the connector housing 6 joined together by the end wall 19.

The top wall 22 comprises a resilient cantilever beam latch 26 (see FIGS. 5–7, and FIG. 3) that has a latching shoulder 28 proximate a free end 30 for engagement with a complementary shoulder 32 of the lever end wall 19 for latching the lever 14 in the fully coupled position as shown in FIGS. 2 and 6. The resilient latch 26 is integrally moulded with the top wall 22 of the housing 6.

Below the top wall 22 is a further wall 34 parallel and spaced therefrom to form a cavity 36 for receiving a secondary locking member 38 slidably therein. The secondary locking member 38 comprises a substantially planar base plate 40 having a pair of integral resilient cantilever beam latches 42,43 extending from opposite ends 44,46 of the plate member 40, to free ends 48,50 spaced apart from each other by a gap, thereby forming opposed retention shoulders 52,54. The shoulders 52,54 are engageable against retention shoulders 56,58 and 60,62 formed by cutouts in the top wall 22 for preventing sliding movement of the secondary locking member 40. The first pair of shoulders 56,58 are for latching the secondary locking member 38 in a pre-locked position, and the shoulders 60,62 are for latching the secondary locking slide member 38 in the fully locked position as shown in FIGS. 2 and 7, whereby the pre-locked position is shown in FIGS. 5 and 6.

Full coupling of the connector assembly 3 to the complementary connector 2 will now be explained with reference to FIGS. 5–7. Initially, as shown in FIG. 5, the lever arm 14 is in the open position and the mating end 18 of the connector assembly 3 can be inserted into the cavity 5 of the complementary connector assembly 2. Engagement of the pinion 10 with a complementary rack member along the side wall of the cavity 5 causes rotation of the gear member 8, which can be assisted by manual rotation of the lever arm 14 until the mating end 18 abuts a mating surface 7 of the complementary connector to give the arrangement as shown in FIG. 6. Upon rotation of the lever arm 14, the lever arm end wall 19 resiliently biases the latching arm 26 until latching engagement of the complementary latching shoulders 32,28. The secondary locking member 38 is in the pre-locked position and prevented from sliding movement by engagement of the resilient latching arm retention shoulders 52,54 with the opposed retention shoulders 56,58 respectively of the housing top wall 22.

In the pre-locked position as shown in FIG. 6 the gear member 8 can be released by depressing the free end 30 of the resilient latch 26, for uncoupling of the connectors 2,3. For securely and reliably locking the connectors 2,3 together, the secondary locking member 38 is shifted to the fully locked position as shown in FIG. 7, by depressing the resilient latch arm 42 such that its shoulder 54 disengages from the housing shoulder 58, and simultaneously pushing on the slidable secondary locking member 38, for example by engagement of a screwdriver in a groove 70 accessible from a top face of the secondary locking member. Depression of the secondary locking member resilient arms 42,43 is possible through the cutouts 55,57,59 through the top wall 22, these cutouts also forming the latching shoulders 56,58 and 60,62.

Upon sliding of the secondary locking member to the fully locked position, the latching arm 43 is cammed below the top wall 22 and then resiliently clicks into engagement with the shoulder 60 once in the fully locked position, the other retention shoulder 54 engaging the opposing retention shoulder 62 of the top wall for retention of the secondary locking member in both opposed axial sliding directions.

In the fully locked position, the end 44 of the secondary locking member 38 engages beneath and against the free end portion 30 of the resilient latching arm 26 thereby preventing biasing of the latching arm. The gear member 8 is thus securely latched and locked in the fully coupled position, thereby securely preventing uncoupling of the connector assemblies 2,3.

Uncoupling of connectors 2,3 can be achieved by inserting a tool in the cutout 59 to depress the latching arm 43 and sliding the secondary locking member 38 to its pre-locked position. The resilient latching member 26 can thus be depressed and the gear member 8 rotated to uncouple the connectors.

Advantageously therefore, a secure and reliable coupling and locking of connector assemblies 2 and 3 is provided.

We claim:

1. An electrical connector assembly matable to a complementary connector assembly, the connector assembly comprising a housing having a main housing section extending between a top wall and a mating end, for receiving electrical terminals therein matable with electrical terminals of a complementary connector assembly, the connector housing further comprising a rotatable gear member having a lever arm and a pinion attached to one end of the lever arm, the pinion having gear teeth engageable with a rack of the complementary connector assembly, the housing having a latch with a retention shoulder engageable with a complementary latching shoulder of the lever arm for retention of the connector assemblies in the mated position, characterized in that the connector assembly comprises a secondary locking member movable from a pre-locked position where the latch and complementary latching shoulder are free to disengage, to a locked position where the latch and latching shoulder cannot disengage, the secondary locking member having a portion movable substantially against the latch to prevent biasing thereof for unlatching of the lever arm, the secondary locking member further comprising retention members cooperable with complementary retention shoulders of the housing to retain the secondary locking members in the pre-locked and locked positions respectively.

2. The connector assembly of claim 1 characterized in that the secondary locking member is slidably received in a cavity adjacent the top wall.

3. The connector assembly of claim 2 characterized in that the latch is a resilient cantilevered beam extending from the top wall to a free end proximate the secondary locking member.

4. The connector assembly of claim 3 characterized in that the secondary locking member has an end portion contiguous the latch free end when in the locked position.

5. The connector assembly of claim 2 characterized in that the secondary locking member retention members are resilient beams having retention shoulders engageable with the complementary retention shoulders which are formed by cutouts through the top wall.

* * * * *